United States Patent [19]

Merenda

[11] Patent Number: 4,796,017

[45] Date of Patent: Jan. 3, 1989

[54] LOW WATER LEVEL ALARM FOR CHRISTMAS TREE STAND

[75] Inventor: Joseph T. Merenda, Northport, N.Y.

[73] Assignee: J. R. Microwave, Inc., Northport, N.Y.

[21] Appl. No.: 5,207

[22] Filed: Jan. 20, 1987

[51] Int. Cl.[4] ..... G08B 21/00

[52] U.S. Cl. ..... 340/620; 73/304 C; 324/61 P

[58] Field of Search ..... 340/620, 618; 73/304 C, 73/304 R; 248/27.8, 523, 524, 525, 526, 527, 528, 529; 47/40.5; 324/61 P; 361/284

[56] References Cited

U.S. PATENT DOCUMENTS

| | | | |
|---|---|---|---|
| 2,938,304 | 5/1960 | Thomas | 248/524 |
| 3,498,131 | 3/1970 | Rickey | 340/620 |
| 3,781,840 | 12/1973 | Roberts | 340/620 |
| 4,075,614 | 2/1978 | White | 340/693 |

*Primary Examiner*—Charles A. Ruehl
*Assistant Examiner*—Jill D. Jackson
*Attorney, Agent, or Firm*—Senniger, Powers, Leavitt and Roedel

[57] ABSTRACT

A resistive water probe is used in combination with a Christmas tree stand to detect a low water level. A low water situation activates lights in a Christmas tree ornament.

12 Claims, 2 Drawing Sheets

LOW WATER LEVEL ALARM FOR CHRISTMAS TREE STAND

BACKGROUND OF THE INVENTION

1. Field of the Invention

The invention generally relates to devices for detecting fluid levels and for indicating when fluid levels are below a given point; and, in particular, to devices for detecting low water levels in a Christmas tree stand and providing an alarm indicating such low water levels.

2. Description of the Prior Art

Fluid sensors are well known in the prior art. For example, humidity sensors are frequently used to determine the humidity level of plant soil. Such humidity detectors frequently have two metal prongs between which the soil is located. The prongs are usually inserted into a plant base so that the soil humidity to be measured is between the prongs. Such devices are not applicable or useful in measuring the water level in a Christmas tree stand.

It is important to keep the water level in a Christmas tree stand above a given level so that the base of the Christmas tree is not exposed to air. When the base is exposed to air, the pores of the base of the tree tend to close and will not absorb further moisture. This results in the cut Christmas tree prematurely drying out. The invention is directed to an apparatus for detecting a low water level in a Christmas tree stand and providing an alarm so that the water may be replaced.

SUMMARY OF THE INVENTION

It is an object of this invention to provide a low water level alarm for a Christmas tree stand.

It is another object of this invention to provide a low cost apparatus which detects the water level in a Christmas tree stand and provides an alarm such as an audible beep when the water level is below a given point.

It is another object of this invention to provide a low water level alarm which is inexpensive and which uses a battery.

It is still another object of the invention to provide a low water level alarm which functions as a Christmas tree ornament.

The apparatus according to the invention is for use in combination with a plant stand, such as a Christmas tree stand. The Christmas tree stand would generally have a container for holding a fluid such as water to feed the plant or Christmas tree. First means senses the fluid in the container. The first means is located in the container and provides an indication when the level of the fluid in the container is below the first means. Means for supporting is provided for supporting the first means at a preselectable location within the container. Second means connected to the first means and a power supply detects the indication and provides an enabling signal in response to the indication. Third means connected to the second means and the power supply generates an alarm in response to receiving the enabling signal from the second means. When the fluid level in the container falls below the first means, the first means provides the indication to the second means which, in turn, provides an enabling signal to the third means, thereby activating the third means and generating an alarm.

DETAILED DESCRIPTION OF THE INVENTION

Figure 1:
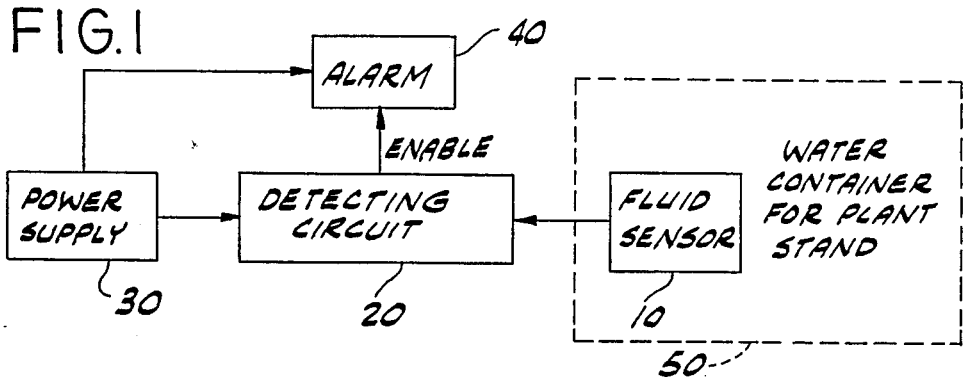
FIG. 1 is a functional diagram of the low water level alarm for a Christmas tree stand according to the invention.

FIG. 1 is a function representation of the invention in block diagram form. In general, fluid sensor 10 is supported within a water container for a plant stand such as an evergreen or Christmas tree stand 50. Sensor 10 senses the fluid in the container and provides an indication when the level of the fluid in the container falls below sensor 10.

Detecting circuit 20 is connected to sensor 10 and is supplied with electrical power by power supply 30 which may be a battery or rectified AC power. Circuit 20 detects the indication from sensor 10 that the water level has fallen below the sensor 10. This indication may be in the form of an open circuit. In response to detecting the indication, circuit 20 provides an enabling signal to alarm 40. Alarm 40, in turn, generates an audio or visual alarm, or both, thereby indicating that stand 50 should be refilled with water to avoid drying of the tree.

Figure 3:
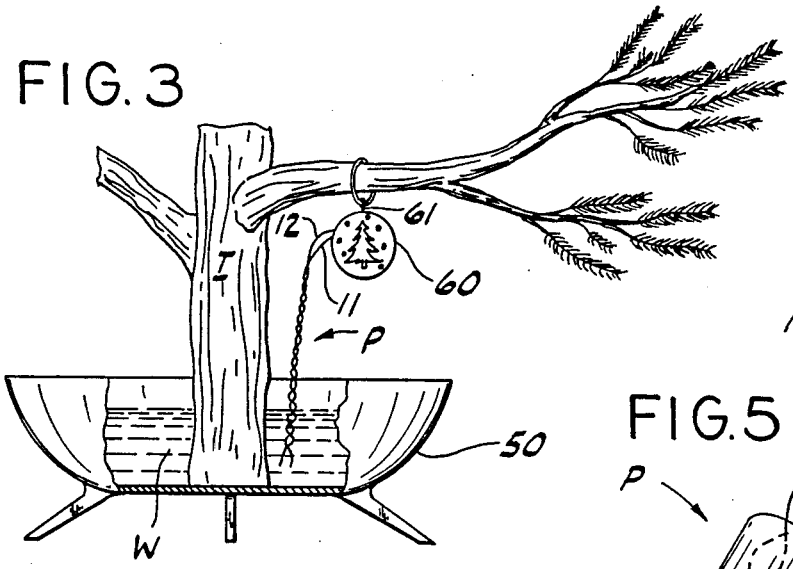
FIG. 3 is an illustration of the invention used in combination with a Christmas tree stand supporting a Christmas tree.

The low water level alarm is designed for low cost and low battery consumption via water sensor 10 which, as shown in FIG. 3, is two rigid or semi-rigid conductors such as wires 11, 12 separated and suspended in the water W. Presence of water W is sensed by the small dc current flow between the two wires 11, 12 through the water W. Material of the wires, separation between the ends of the wires, depth in the water and precise resistance of the water are not important to the circuit operation. A piezo-electric transducer 41 driven by cascaded 555 timers 42 produce a pulsed tone and an optional visual alert by energizing light 43 when switch 44 is closed, to complete the low cost design.

Low battery consumption is achieved both in the full water and low water audio alert mode. A standard 9 volt battery is used as power supply 30. Those batteries are rated between 200 and 500 milliamp hours. A majority of operation is in the full water mode. The warning circuitry is entirely disabled during that time. A maximum of 40 microamps in current is drawn, allowing greater than 1 year continuous operation in that mode. During the audio alert cycle, the audio is pulsed at a low duty cycle to conserve the battery. An average current of 3 milliamps flows, enabling nearly a week of continuous audio before the battery dies.

The pulsed audio occurs about once a second at less than 10% duty cycle. The audio tone at 2.5 KHz has been selected at the optimum response frequency of the piezo-electric transducer 41. The 2.5 KHz is clearly audible, yet not annoying to someone who might be watching TV in the same room.

In the full water mode, current flows from the 9 volt battery through the wires 11, 12 and the water and R1 into the base of Q1. In this mode Q1 is saturated because of its high collector resistance. Since the transistors have a minimum Beta of 100, the resistance between the probes need only be less than 47 Megaohms to assure saturation. R1 and C1 cause a delay of about 1 second before the alarm will sound, preventing periodic alerts caused by electrical transients or splashing of the water. R1 is also used to limit the base current to 20 microamps in the event of a very low resistance between the probes.

When Q1 is saturated, its collector voltage falls to several tenths of a volt. The Darlington switch formed by Q2 and Q3 requires 1.4 volt base drive to turn on. Hence, Q2 and Q3 will be off. The entire audio alert circuit is connected between the common collectors of the Darlington switch and 9 volts. Therefore, when Q1 is saturated, Q2 and Q3 are off and no current flows through the alarm circuit.

When the water level drops below probe 10 or the probe is removed from the water, the base current of Q1 is interrupted, and Q1 shuts off. Its collector rises above 1.4 volts, enabling the Darlington switch to turn on. The current drive to the base of Q2 is limited to about 20 microamps by R2. R2 cannot be made smaller because it also controls the current flow during the full water mode. Since the base drive to Q2 is so small, it was necessary to use a Darlington connection to amplify the current to the peak value drawn by the alarm circuit.

When the Darlington switch is on, the alarm circuit 40 is effectively connected between 9 volts and ground. Both 555's are connected in a free-running, astable mode. The duty cycle of the 555 can be adjusted between 0.5 and 1. The duty cycle of the first one is set to about 0.95. The output at pin 3 is high, (9 v), 95% of the time while dropping to ground 5% of the time. The frequency has been set of approximately 1 hertz.

The output of the first 555 is connected to the ground connection (pin 1) of the second 555. Hence, the second 555 is enabled only when the first output drops to ground or 5% of the time. The second 555 is free running at 2.5 KHz when enabled. Its duty cycle has been set to 0.5 so that a square wave is produced at its output, (pin 3). The piezo-electric transducer will not draw dc current. Therefore, it can be connected directly to the output of the second 555 without a coupling capacitor.

Figure 2:
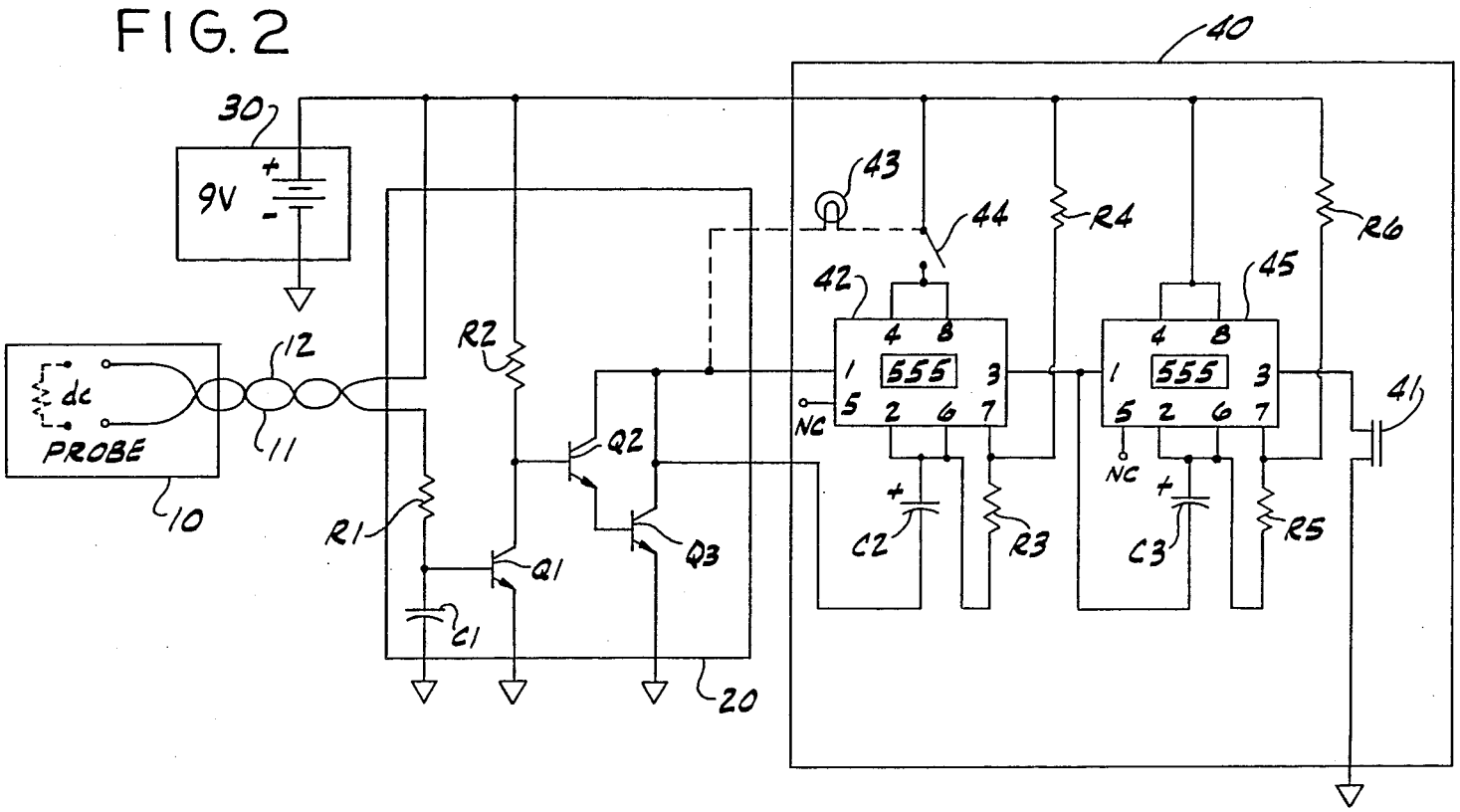
FIG. 2 is a circuit diagram of the invention of FIG. 1 shown in block diagram form.

FIG. 3 illustrates the invention in use in combination with a Christmas tree T. All circuitry as shown in FIG. 2 is enclosed in a housing 60 which, preferably, is decorated as a Christmas tree ornament and includes a hook 61 premitting the housing to be hung from the tree. Wires 11 and 12 which form the probe P which functions as fluid sensor 10 project from housing 60 and are located within container 50. Generally, wires 11 and 12 may be any semi-rigid wires which are coated with insulation. The ends of the wires are uncoated or bare so that they are in contact with the water W.

Figure 4:
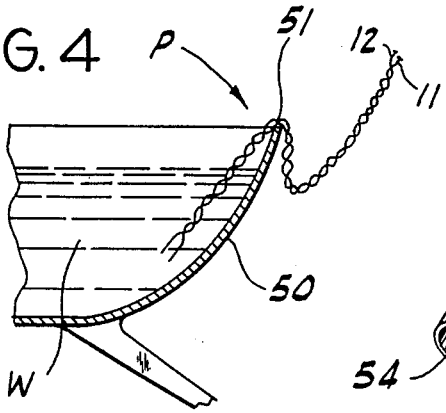
FIG. 4 is a partial illustration of an alternative embodiment for engaging the probes of the invention with a fluid container.
Figure 5:
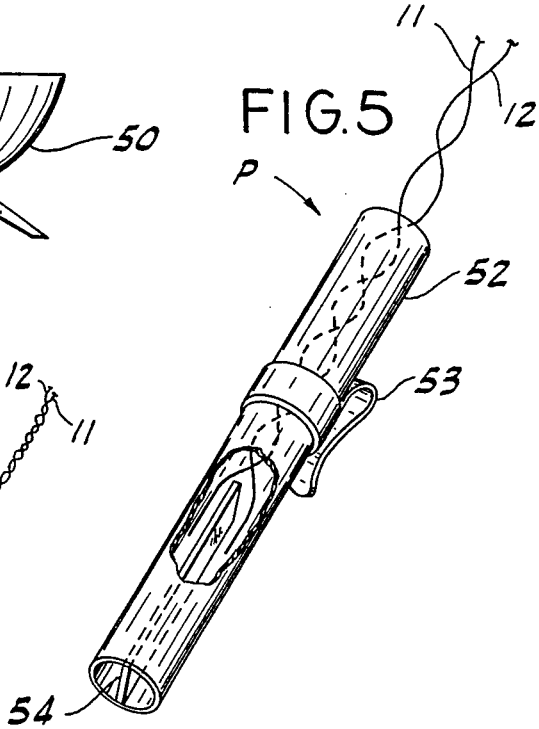
FIG. 5 is another alternative embodiment of a probe according to the invention.

FIG. 4 shows an alternative configuration for the probe P and wires 11 and 12. As shown in FIG. 4, wires 11 and 12 are bent around the edge 51 of container 50 so that the ends of the wires are held in a given position within container 50. FIG. 5 shows yet another alternative termination arrangement for probe P and wires 11 and 12. As shown in FIG. 5, wires 11 and 12 are terminated in a tubular member 52 having a clip 53 which may engage the edge of the Christmas tree stand container. Tubular member 52 may also be provided with a separating diaphragm 54 so that wire 11 is on one side of the diaphragm and wire 12 is on the other side of the diaphragm.

It being understood that various changes in the form, proportions, and minor details of construction, within the scope of the claim may be resorted to without departing from the spirit or sacrificing any of the advantages of the invention.

What is claimed is:

1. An apparatus for use in combination with a plant stand, such as a Crhistmas tree stand, having a container for holding a fluid, such as water, to feed the plant, said apparatus comprising:

sensing means for sensing the fluid in the container, said sensing means located in the container and providing an indication when the level of the fluid in the container is below the sensing means;

supporting means for supporting the sensing means at a preselectable location within the container;

a power supply detecting means, connected to the sensing means and the power supply, for detecting the indication and providing an enabling signal in response to the indication;

generating means, connected to the detecting means adn the power supply, for generating an alarm in response to receiving the enabling signal from the detectng means whereby when the fluid level in the container falls below the sensing means, the sensing means provides the indication to the detecting means which, in turn, provides an enable signal to the generating means, thereby activating the generating means and generating an alarm; and a housing enclosing said power supply, said detecting means and said generating means, said housing having a support for engaging the plant and for supporting the housing from the plant.

2. The apparatus of claim 1 wherein said housing comprises a Christmas tree ornament.

3. The apparatus of claim 1 wherein said sensing means and said supporting means comprise a dual conductor probe extending from said housing; and said detecting means comprises an open-circuit sensing circuit connected to the probe, said sensing circuit providing the enabling signal when the probe is substantially an open circuit.

4. The apparatus of claim 3 wherein said generating means comprises a pulsing audio circuit providing a pulsed driving signal in response to the enabling signal and a transducer, connected to the audio circuit, converting the drive signal into an audio signal.

5. The apparatus of claim 1 wherein said supporting means includes an engaging means, connected to the sensing means, for engaging the plant stand.

6. The apparatus of claim 5 wherein the plant stand is a Christmas tree stand and the fluid is water and further comprising a housing enclosing said power supply, said detecting means and said generating means, said housing comprising a Christmas tree ornament and having a support engaging a Christmas tree and supporting the housing from the Christmas tree.

7. An apparatus comprising:

a plant stand, such as a Christmas tree stand, having a container for holding a fluid, such as water, to feed the plant;

first means for sensing the fluid in the container, said first means located in the container and providing an indication when he level of the fluid in the container is below the first means;

means for supporting the first means at a preselectable location within the container;

a power supply;

second means connected to the first means and the power supply, for detecting the indication and providing an enabling signal in response to the indication;

third means, connected to the second means and the power supply, for generating an alarm in response to receiving the enabling signal from the second means; and a housing enclosing said power supply, said second means and said third means, said housing having support means for engaging the housing and supporting the housing from the plant whereby when the fluid level in the container falls below the first means, the first means provides the indication to the second means which, in turn, provides an enable signal to the third means, thereby activating the third means and generating an alarm.

8. The apparatus of claim 7 wherein said housing comprises a Christmas tree ornament.

9. The apparatus of claim 7 wherein said means for supporting includes a means, connected to the first means, for engaging the plant stand.

10. The apparatus of claim 7 wherein said plant stand comprises a Christmas tree stand and said support means engages the Christms tree.

11. The apparatus of claim 7 wherein said first means and said means for supporting comprise a dual conductor probe extending from said housing; and said second means comprises an open-circuit sensing circuit connected to the probe, said sensing circuit providing the enabling signal when the probe is substantially an open circuit.

12. The apparatus of claim 11 wherein said third means comprises a pulsing audio circuit providing a pulsed driving signal in response to the enabling signal and a transducer, connected to the audio circuit, converting the drive signal into an audio signal.

* * * * *